US006460719B1

(12) United States Patent
Finmark

(10) Patent No.: US 6,460,719 B1
(45) Date of Patent: Oct. 8, 2002

(54) COVER FOR A TAB TOP CAN AND METHOD OF USE

(76) Inventor: Brian E. Finmark, 2030 S. Cabrillo Ave. #101, San Pedro, CA (US) 90731

( * ) Notice: Subject to any disclaimer, the term of this patent is extended or adjusted under 35 U.S.C. 154(b) by 0 days.

(21) Appl. No.: 09/826,022

(22) Filed: Apr. 4, 2001

Related U.S. Application Data

(60) Provisional application No. 60/197,632, filed on Apr. 17, 2000.

(51) Int. Cl.[7] ..... B65D 51/20

(52) U.S. Cl. ..... 220/258.5; 81/3.55; 220/258.3; 220/258.2; 220/906; 220/730; 220/212; 206/459.5

(58) Field of Search ..... 84/3.55, 3.09; D8/18, 34, 40; D9/436–438; 40/307; 220/269, 270, 906, 730, 272, 273, 212, 258, 259, 787, 345.1, 350, 729, 712, 713, 694, 258.1–258.5, 259.1; 206/459.1, 459.3, 217

(56) References Cited

U.S. PATENT DOCUMENTS

| | | | | | |
|---|---|---|---|---|---|
| 3,476,284 | A | * | 11/1969 | Callegari | D9/438 |
| 3,622,034 | A | * | 11/1971 | Lutzker et al. | 220/784 |
| 3,822,496 | A | * | 7/1974 | Minder | 40/307 |
| 3,958,354 | A | * | 5/1976 | Hough et al. | 40/307 |
| 4,057,166 | A | * | 11/1977 | Yamazaki et al. | 220/345.3 |
| D249,984 | S | * | 10/1978 | Parker | D8/34 |
| 4,414,865 | A | * | 11/1983 | Brooks et al. | 81/3.09 |
| 4,455,894 | A | * | 6/1984 | Roberts | 81/3.09 |
| D276,691 | S | * | 12/1984 | Nielsen | D8/34 |
| 4,530,260 | A | * | 7/1985 | Holka | 81/3.55 |
| 4,534,088 | A | * | 8/1985 | Ricke | 220/787 |
| 4,598,435 | A | * | 7/1986 | Borodulin et al. | 81/3.09 |
| 4,719,824 | A | * | 1/1988 | Chagoya | 81/3.09 |
| D297,204 | S | * | 8/1988 | Duerst, Jr. | D8/40 |
| 4,829,618 | A | * | 5/1989 | McKee | 81/3.09 |
| 5,285,924 | A | * | 2/1994 | Morris | 220/729 |
| 5,316,166 | A | * | 5/1994 | Pavely et al. | 220/269 |
| 5,351,853 | A | * | 10/1994 | Shock | 220/258 |
| 5,509,380 | A | * | 4/1996 | Tipp | 81/3.55 |
| 5,799,815 | A | * | 9/1998 | Lang | 220/258 |
| 5,911,794 | A | * | 6/1999 | Nordhoff | 81/3.55 |
| 6,032,816 | A | * | 3/2000 | Martin | 220/269 |
| 6,082,030 | A | * | 7/2000 | Kesselring et al. | 40/307 |
| 6,098,830 | A | * | 8/2000 | Jamieson | 220/258 |
| 6,105,200 | A | * | 8/2000 | Cooper | 81/3.09 |

FOREIGN PATENT DOCUMENTS

| | | | |
|---|---|---|---|
| EP | 558422 | * | 9/1993 |
| JP | 11-342941 | * | 12/1999 |

* cited by examiner

*Primary Examiner*—Nathan J. Newhouse
*Assistant Examiner*—Robin A Hylton
(74) *Attorney, Agent, or Firm*—Ted Masters

(57) ABSTRACT

A cover for a tab top can having a top with a tab opener includes a body which is shaped and dimensioned to selectively cover the hole which is punched by the tab opener. The body has a channel which is shaped and dimensioned to receive the tab opener. Once the can is opened in the conventional manner, the cover is slidably installed on the tab opener. The cover and tab opener are then rotated until the cover covers the hole in the top of the can, thereby preventing both spilling and the unwanted entry of contamination. As desired, the cover may then be rotated away from the hole to dispense the contents of the can.

2 Claims, 8 Drawing Sheets

COVER FOR A TAB TOP CAN AND METHOD OF USE

CROSS REFERENCE TO RELATED APPLICATION

This application claims the filing benefit under 35 U.S.C. § 119(e) of U.S. Provisional Application No. 60/197,632, filed Apr. 17, 2000, which is included herein by reference.

TECHNICAL FIELD

The present invention pertains generally to cans such as beverage cans, and more particularly to cans of the tab top variety wherein a tab opener is used to punch a hole or mouth in the can. After opening, a cover is installed on the tab opener, and the cover and tab opener may then be selectively rotated to cover and uncover the hole in the top of the can.

BACKGROUND OF THE INVENTION

Tab top cans, also known as retained cap cans, are well known in the art. These cans include a tab opener which is attached to the top of the can. The can is opened by lifting one end of the tab opener thereby causing the other end to open a door in the top of the can, and create a hole or mouth in the can from which the contents can be dispensed. After the door has been moved inside the can and out of the way of the hole, the tab opener is pushed back to near its original position.

However, a problem exists with tab top cans. Once the can is open it cannot conveniently be closed. As such, contaminants can enter the open top, and the contents can easily be spilled. Attempts have been made to correct this deficiency by placing various type covers over the entire top of the opened can.

SUMMARY OF THE INVENTION

The present invention is directed to an improved cover for a tab top can, which enjoys many advantages over previous can covers. A preferred name for the present invention is "TAB-TOP". The present invention includes a cover which has a channel for receiving the can's tab opener. After the can is opened in the conventional manner, the cover is slid over and snugly engages the tab opener. That is, the cover acts as a sheath which surrounds the tab opener. The cover and tab opener may then be horizontally rotated so that the cover resides over the hole in the can, thereby preventing the entry of contaminating agents and preventing spills. The cover may then be selectively rotated away from the hole to dispense the contents of the can.

FEATURES AND ADVANTAGES OF THE INVENTION

The cover of the present invention only covers the hole in the top of the can, and not the entire top of the can.

When in place over the hole, the cover prevents the contents of the can from spilling or splashing out.

When in place over the hole, the cover prevents contamination from entering the can.

The cover is useful for the display of advertising information such as LOGOs, trademarks, and the like.

The cover comes in assorted colors to add a personal look.

The cover is small and will conveniently fit into a pocket, purse, or on a key chain adapter designed to slidably receive the cover.

The cover assists in the retention of carbonation.

Unlike some devices which cover the entire top of the can and have to be removed for drinking, the present invention stays on the can until the beverage is consumed.

The cover is reusable.

The cover is washable and may therefore be keep sanitary.

One end of the cover can be used to pry up the can's tab opener. This prevents broken or chipped fingernails In accordance with a preferred embodiment of the invention, a cover for a can having a top with a tab opener, wherein the tab opener is used to punch a hole in the top, includes a flattened body shaped and dimensioned to cover the hole in the can. The body has a channel shaped and dimensioned to slidably and snugly receive the tab opener, so that the cover may be slidably installed on the tab opener after the can is opened.

In accordance with an important aspect of the invention, the channel is formed by two spaced apart flanges which slidably engage the tab opener. In one embodiment, the two spaced apart flanges have flared lips to facilitate acceptance of the tab opener.

In accordance with another important aspect of the invention, the bottom of the body has at least one protuberance which enters an opening in the tab opener when the cover is installed upon the tab opener. The protuberance serves to hold the cover in place on the tab opener.

In accordance with another important feature of the invention, the body has a tapered end which is useful in prying the tab opener away from the top of the can to aid in the opening process.

Other features and advantages of the present invention will become apparent from the following detailed description, taken in conjunction with the accompanying drawings, which illustrate, by way of example, the principles of the invention.

DETAILED DESCRIPTION OF THE INVENTION

Figure 1:
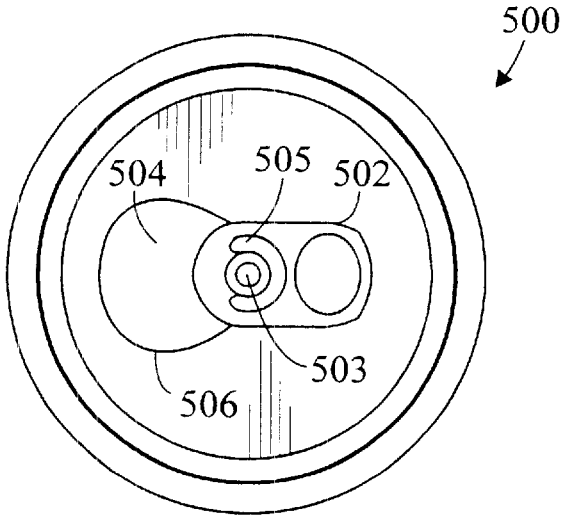
Fig. 1 PRIOR ART
FIG. 1 is a top plan view of a can having a tab opener before the can is opened.
Figure 2:
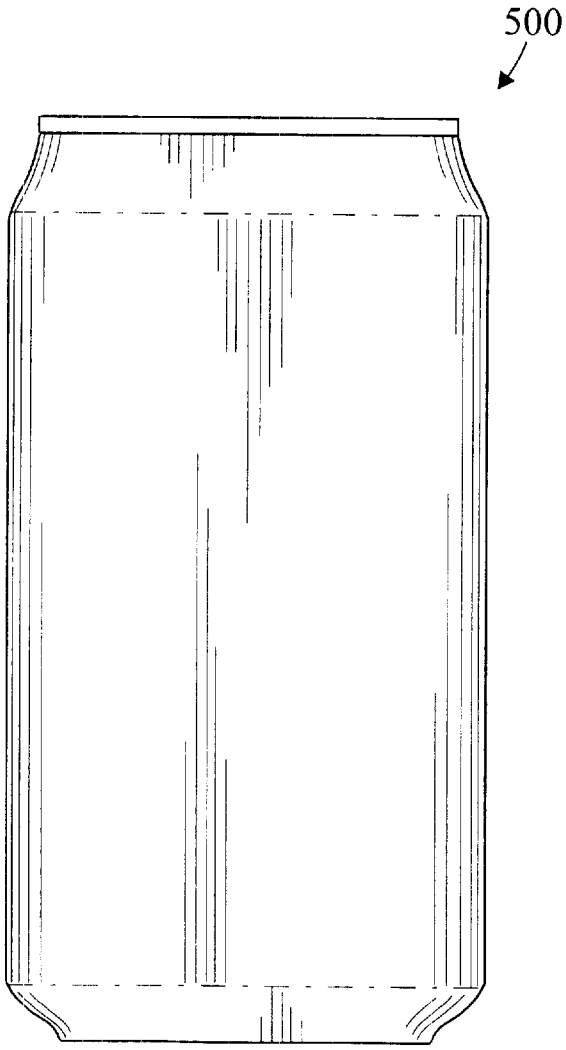
Fig. 2 PRIOR ART
FIG. 2 is a side elevation view of the can.

Referring initially to FIGS. 1 and 2, there are illustrated top plan and side elevation views respectively of a prior art can 500 having a tab opener 502 before the can 500 is opened. Tab opener 502 is centrally attached to the top of can 500 with a rivet-like device 503 about which tab opener 502 may be rotated. Can 500 is typically fashioned from aluminum, and the top includes a door 504 which has a frangible perimeter 506. Tab opener 502 also has an opening 505 located near the center of the top of can 500. This opening 505 is often in the form of a semicircle.

Figure 3:
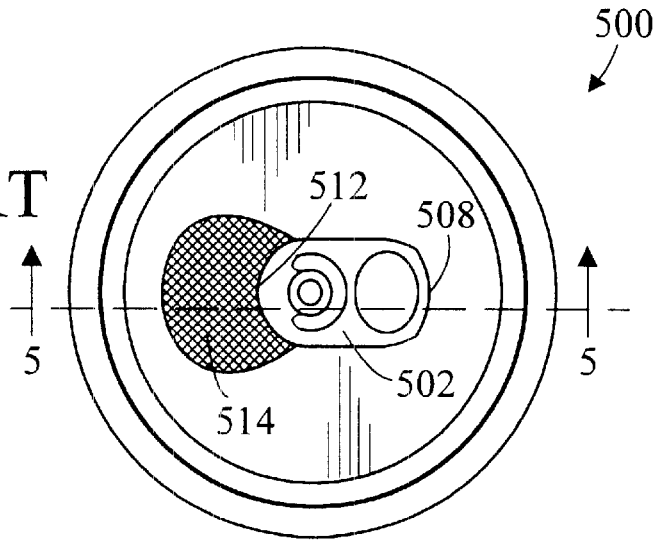
Fig. 3 PRIOR ART
FIG. 3 is top plan view of the can after the tab opener has been used to punch a hole in the top of the can.
Figure 4:
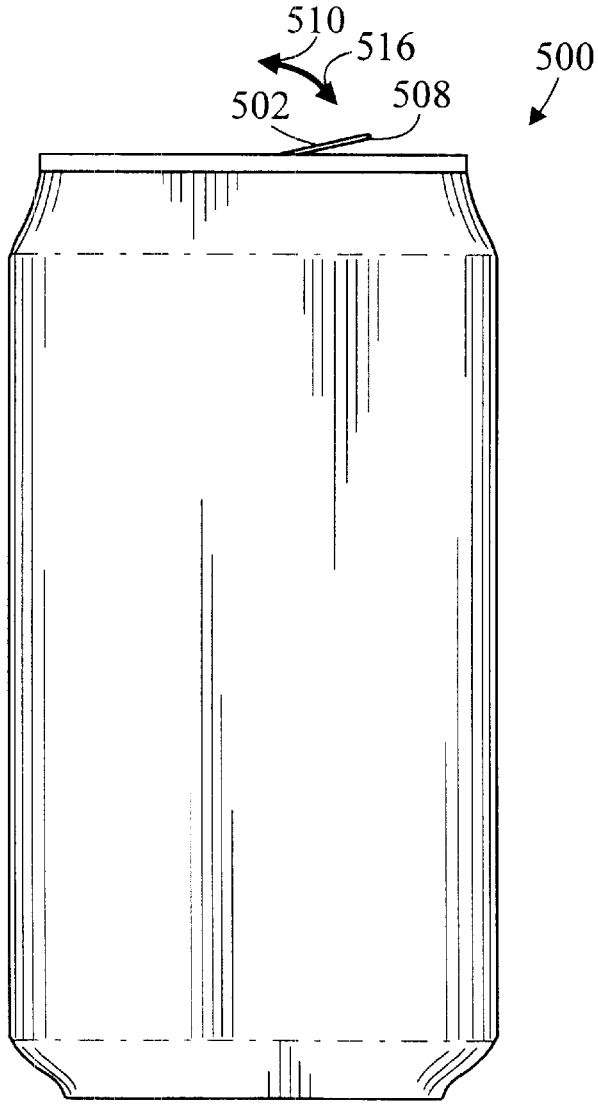
Fig. 4 PRIOR ART
FIG. 4 is a side elevation view of FIG. 3.

Now referring to FIGS. 3 and 4, there are illustrated top plan and side elevation views respectively of can 500 after tab opener 502 has been used to punch a hole 514 in the top of the can 500. Pull end 508 of tab opener 502 is manually lifted in direction 510. This causes push end 512 of tab opener 502 to force door 504 (refer to FIG. 1) down thereby rupturing frangible perimeter 506, moving door 504 into can 500, and creating hole or mouth 514. Once this process is completed, tab opener 502 is manually rotated back in direction 516, and the contents of can 500 dispensed though hole 514.

Figure 5:
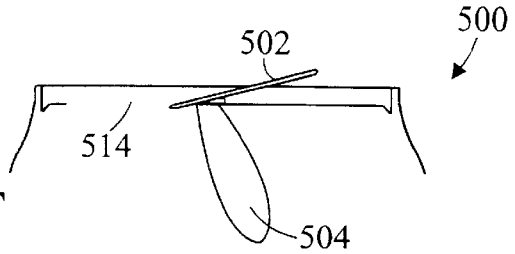
Fig. 5 PRIOR ART
FIG. 5 is a fragmented view along the line 5—5 of FIG. 3.
Figure 6:
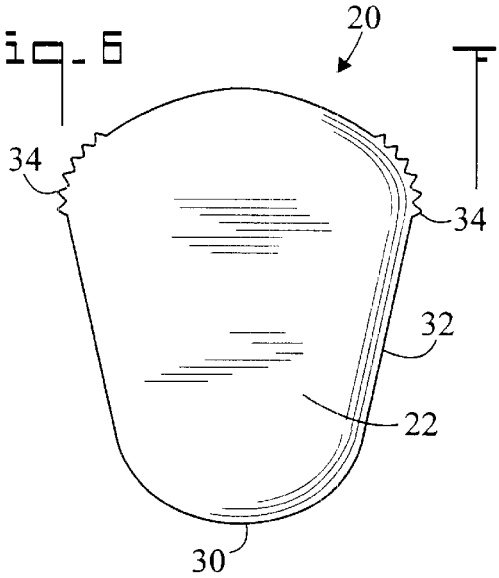
FIG. 6 is an enlarged top plan view of a cover for a tab top can in accordance with the present invention.
Figure 9:
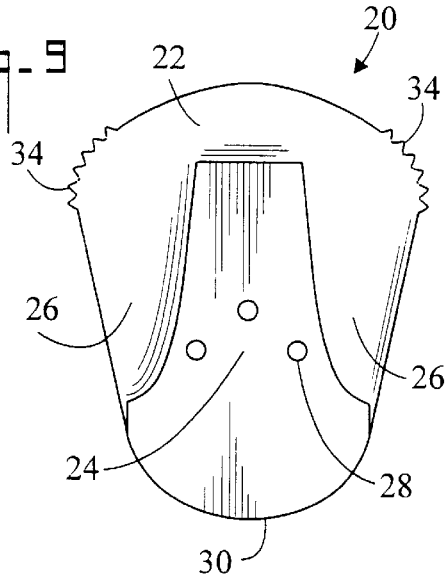
FIG. 9 is an enlarged bottom plan view of the cover.
Figure 7:
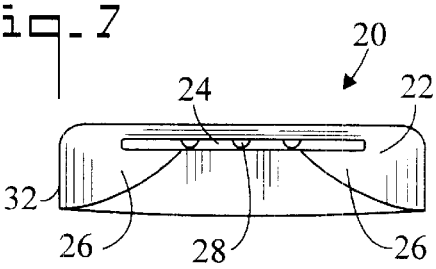
FIG. 7 is an enlarged end elevation view of the cover.
Figure 10:
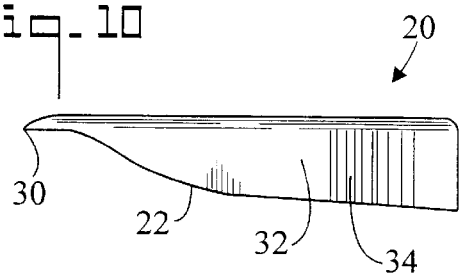
FIG. 10 is an enlarged side elevation view of the cover.
Figure 8:
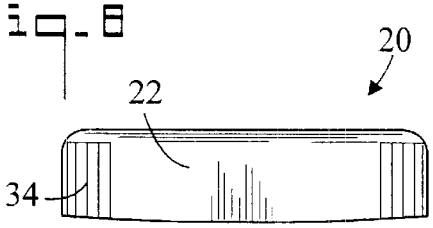
FIG. 8 is an enlarged opposite end elevation view of the cover.

FIG. 5 is a fragmented view along the line 5—5 of FIG. 3. Tab opener 502 has forced door 504 into can 500, thereby creating hole 514.

Now referring to FIGS. 6–10, there are illustrated enlarged top plan, end elevation, opposite end elevation, bottom plan, and side elevation views respectively, of a cover for a can 500 having a tab opener 502 in accordance with the present invention, generally designated as 20. Cover 20 includes a body 22 which is shaped and dimensioned to completely cover hole 514 which is punched in the top of can 500. It may be appreciated that body 22 can be made in various sizes and shapes to accommodate different size and shapes of holes 514. Body 22 has a channel 24 which is shaped and dimensioned to slidably receive tab opener 502, so that cover 20 may be slidably installed and snugly engage tab opener 502. In the shown preferred embodiment, channel 24 is formed by two spaced apart flanges 26 (also refer to FIG. 20). However, it may also be appreciated that channel 24 could be of other configurations so long as it can accept tab opener 502.

Body 22 has at least one protuberance 28. Protuberance 28 enters and engages opening 505 in tab opener 502 when cover 20 is installed upon the tab opener 502. The protuberance 28 serves to keep cover 20 from moving once it is installed on tab opener 502. In the shown preferred embodiment, three protuberances 28 are disposed on the bottom of body 22, and engage semicircular opening 505 in tab opener 502 (also refer to FIG. 20).

Figure 19:
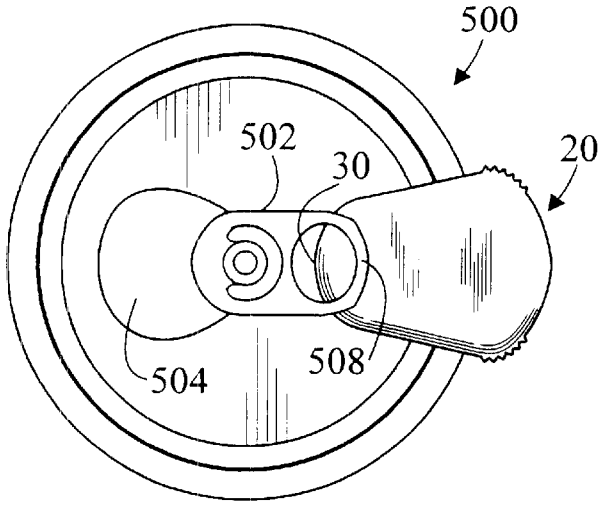
FIG. 19 is a top plan view showing the tapered end of the cover being used to pry the tab opener away from the top of the can.

Body 22 has a tapered end 30. During the can 500 opening process, tapered end 30 is useful in initially prying tab opener 502 away from the top of can 500. This avoids damage to fingernails. Refer also to FIG. 19. Body 22 also has an edge 32 which has knurls 34 for better gripping.

Figure 11:
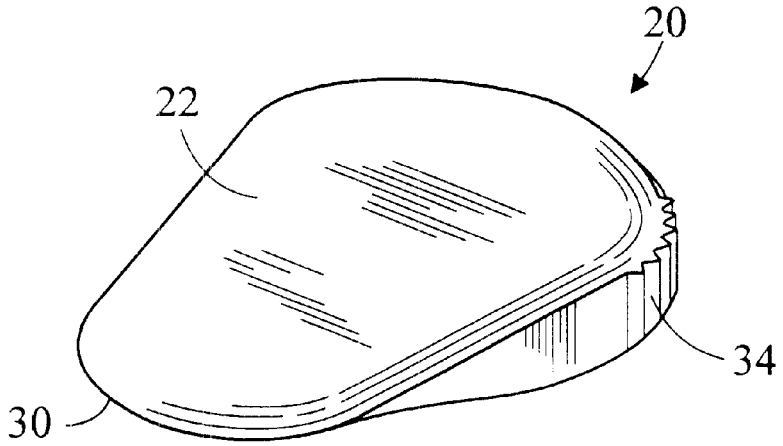
FIG. 11 is an enlarged perspective view of the cover.
Figure 12:
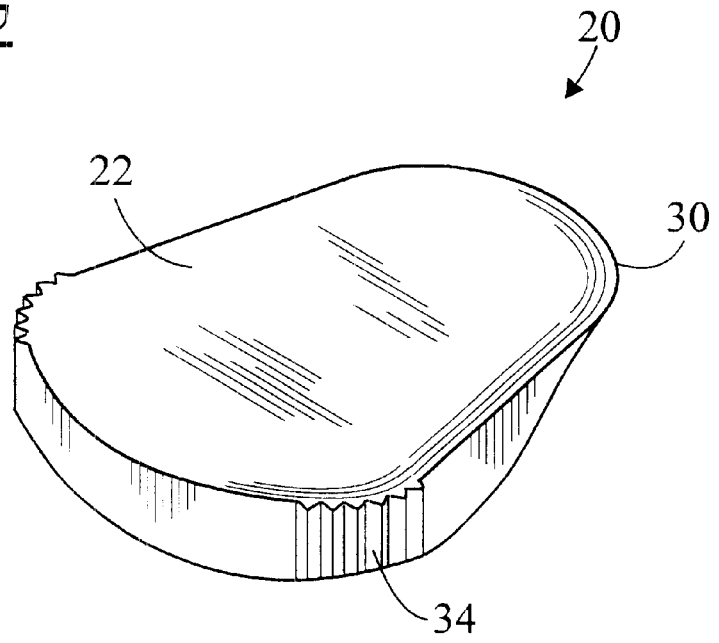
FIG. 12 is an enlarged opposite perspective view of the cover.

FIGS. 11 and 12 are enlarged perspective and opposite perspective views respectively of cover 20.

Figure 13:
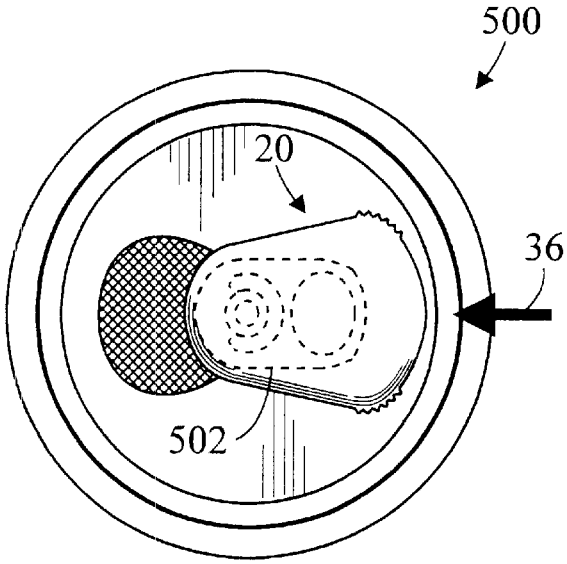
FIG. 13 is a top plan view of the cover slidably installed on the tab opener.
Figure 14:
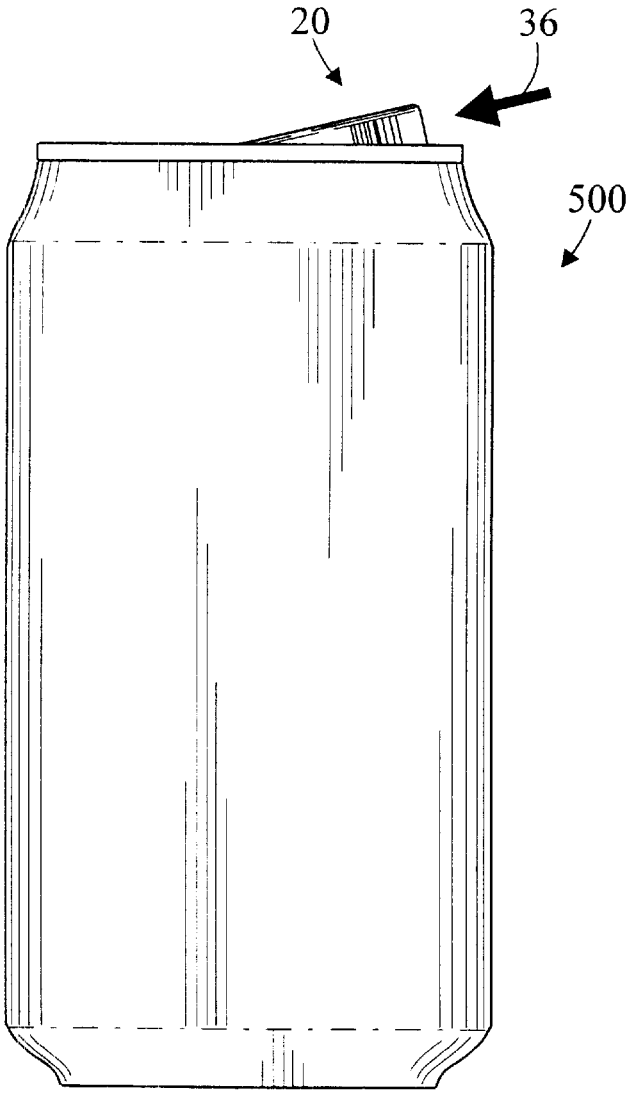
FIG. 14 is a side elevation view of FIG. 13.

FIGS. 13 and 14 are top plan and. side elevation views respectively of cover 20 slidably installed on tab opener 502. Channel 24 (refer to FIGS. 7 and 9) in body 22 accepts tab opener 502, and cover 20 is longitudinally slid onto tab opener 502 in direction 36 so that cover 20 surrounds tab opener 502 (also refer to FIG. 20).

Figure 15:
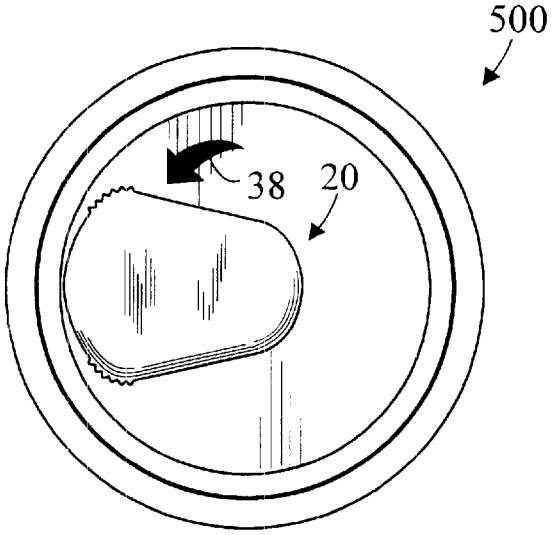
FIG. 15 is a top plan view of the cover and tab opener rotated to cover the hole in the top of the can.
Figure 16:
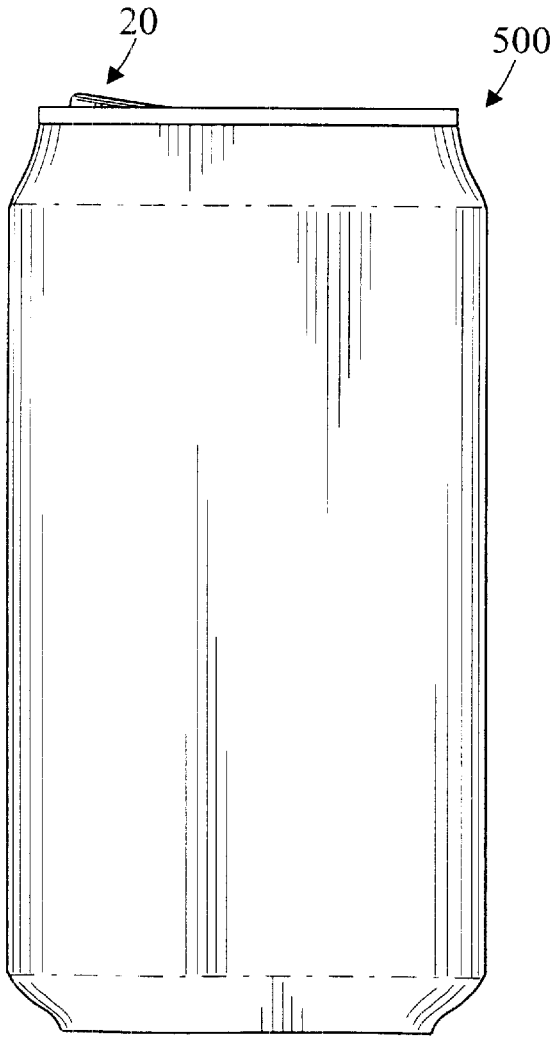
FIG. 16 is a side elevation view of FIG. 15.

FIGS. 15 and 16 are top plan and side elevation views respectively of cover 20 and tab opener 502 rotated in direction 38 to cover hole 514 in the top of can 500. With cover 20 in place, contamination cannot enter can 500 nor can the contents be spilled. The rotation is made possible by the rivet-like device 503 which attaches tab opener 502 to the top of can 500 (refer to FIG. 1).

Figure 17:
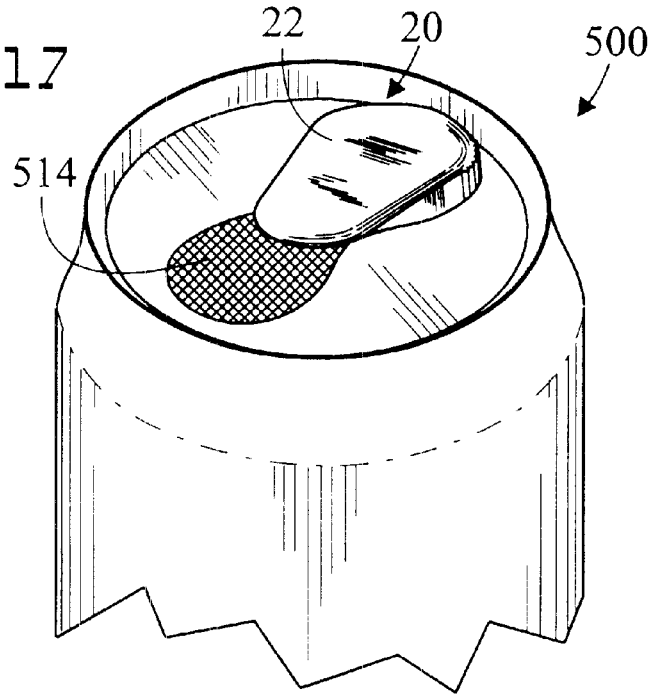
FIG. 17 is a fragmented perspective view of the cover installed on the tab opener.

FIG. 17 is a fragmented perspective view of cover 20 installed on tab opener 502 of can 500.

Figure 18:
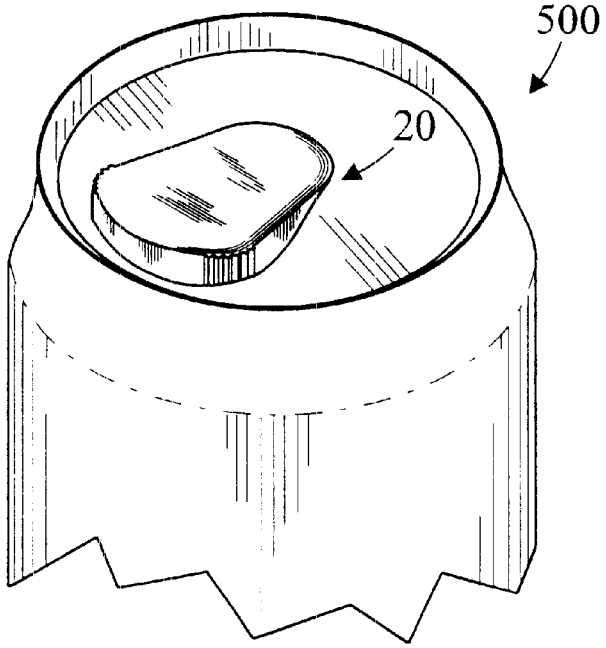
FIG. 18 is a fragmented perspective view of the cover and tab opener rotated to cover the hole in the top of the can.

FIG. 18 is a fragmented perspective view of cover 20 and tab opener 502 rotated to cover hole 514 in the top of can 500.

FIG. 19 is a top plan view showing tapered end 30 of cover 20 wedged under pull end 508 of tab opener 502, and being used to pry tab opener 502 away from the top of can 500, instead of having to utilize a fingernail for this purpose.

Figure 20:
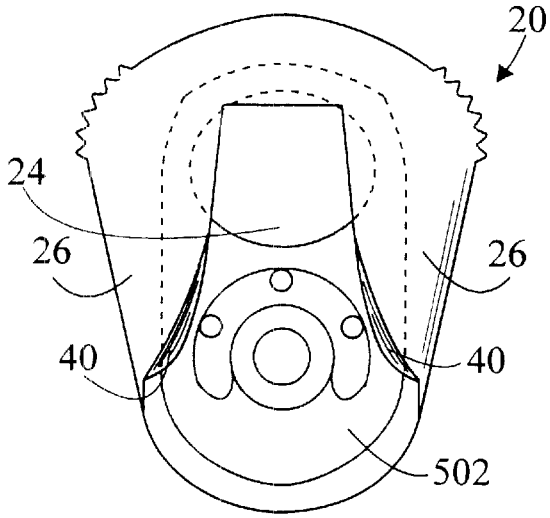
FIG. 20 is an enlarged bottom plan view of the cover showing an alternative embodiment in which two spaced apart flanges have flared lips to facilitate acceptance of the tab opener; and, FIG. 21 is an enlarged top plan view of the cover showing indicia disposed thereon.

FIG. 20 is an enlarged bottom plan view of cover 20 showing an alternative embodiment in which two spaced apart flanges 26 have flared lips 40 to facilitate acceptance of tab opener 502.

Figure 21:
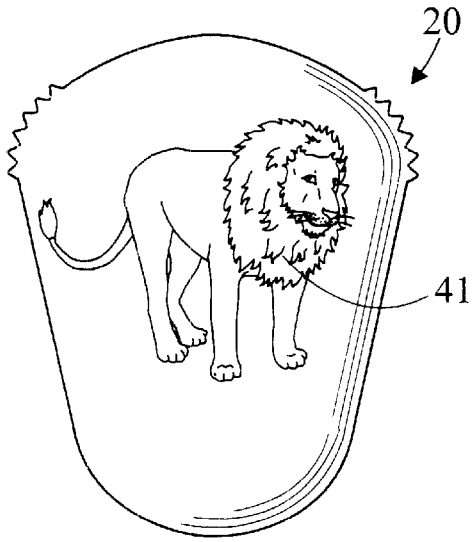

FIG. 21 is an enlarged top plan view of cover 20 showing indicia 41 disposed thereon.

The cover 20 of the present invention may be fabricated from a variety of materials. A semi-riged vinyl plastic, such as V-470 having a Shore Hardness of 78 has been found useful. In a preferred embodiment, the present invention is manufactured using injection molding procedures.

In terms of use, a method of covering the top of a beverage can, comprises:

(1) providing a conventional can having a top with a tab opener;

(2) using the tab opener to punch a hole in the top of the can;

(3) providing a cover having a body shaped and dimensioned to cover the hole, the body having a channel shaped and dimensioned to slidably receive the tab opener;

(4) sliding the cover onto the tab opener; and, (5) rotating the cover and tab opener so that the cover is disposed over the hole.

The method can also include:

the body having a tapered end; and, as a part of step (2), using the tapered end to pry the tab opener away from the top of the can.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A cover for a can with a top having a tab opener, wherein the tab opener is used to punch a hole in the top of the can, the top having a centrally disposed rivet device which attaches the tab opener to the top of the can, and about which the tab opener may be rotated, the tab opener. having a substantially semicircular opening having an edge, the semicircular opening partially surrounding the rivet device, and the tab opener having a longitudinal centerline which bisects the semicircular opening, said cover comprising:

a body shaped and dimensioned to cover the holed;

said body having a channel shaped and dimensioned to slidably receive the tab opener, so that said cover may be installed on the tab opener; and, said body having at least one protuberance, said protuberance dimensioned and positioned to engage the semicircular opening of the tab opener, so that when said cover is installed on the tab opener, said protuberance enters the semicircular opening and thereby retains said cover on the tab opener.

2. A cover according to claim 1, further including:

said body having three spaced-apart said protuberances, said protuberances dimensioned and positioned to engage the semicircular opening of the tab opener, so that when said cover is installed on the tab opener, said protuberances enter the semicircular opening and abut the edge of the semicircular opening, wherein a first said protuberance is disposed substantially on the longitudinal centerline of the tab opener, a second said protuberance is disposed on one side of the longitudinal centerline of the tab opener, and a third protuberance is disposed on an opposite side of the longitudinal centerline of the tab opener from said second protuberance, so that said protuberances retain said cover in place on the tab opener both along and perpendicular to the centerline of the tab opener.

* * * * *